United States Patent [19]

Güttinger

[11] Patent Number: 4,611,479

[45] Date of Patent: Sep. 16, 1986

[54] METHOD AND APPARATUS FOR ROLLING METAL FOILS

[75] Inventor: Heinz Güttinger, Schaffhausen, Switzerland

[73] Assignee: Sulzer-Escher Wyss Limited, Zürich, Switzerland

[21] Appl. No.: 675,075

[22] Filed: Nov. 26, 1984

[30] Foreign Application Priority Data

Feb. 6, 1984 [CH] Switzerland ..... 532/84

[51] Int. Cl.[4] ..... B21B 37/02; B21B 31/16

[52] U.S. Cl. ..... 72/16; 72/243; 72/245

[58] Field of Search ..... 72/16, 243; 29/113 AD, 29/116 AD

[56] References Cited

U.S. PATENT DOCUMENTS 4,480,452 11/1984 Schnyder ..... 72/16

4,480,537 11/1984 Agronin et al. ..... 29/116 AD

*Primary Examiner*—Francis S. Husar

*Assistant Examiner*—Jorji M. Griffin

*Attorney, Agent, or Firm*—Werner W. Kleeman

[57] ABSTRACT

In rolling metal foils, such as aluminum foils, especially very thin foils in the range down to 10 μm, an improved uniformity of the foil thickness over the width of the foil sheet and, simultaneously, greater rolling speeds of the foil sheet are obtained by operating the rolling apparatus at a working point of the rolling force/material-working or line force/deformation characteristic curve which lies below the saturation region in which, while the material-working or deformation is nearly independent of the rolling or line force, the rolling or pulling speed is determined by other parameters and can not be varied. The thickness variations occurring under this selection of the working point and due to variations in the rolling or line force over the width of the rolls are compensated by regulating the rolling or line force such that the thickness reduction is constant over the width of the sheet or has a desired profile of variation. This can be obtained by, for instance, constructing one or more of the rolls as a controlled deflection roll provided with a series of pressure or support elements having regulatable pressing forces distributed over the width of the roll.

8 Claims, 2 Drawing Figures

METHOD AND APPARATUS FOR ROLLING METAL FOILS

BACKGROUND OF THE INVENTION

The present invention broadly relates to rolling metal foils and, more specifically, pertains to a new and improved method and apparatus for rolling metal foils in which a sheet of metal of a predetermined width is conducted between two work rolls pressed together with a predetermined rolling or line force at a predetermined sheet or web speed for effecting a thickness reduction of the sheet of metal from an initial value of thickness to a final value of thickness.

The invention particularly relates to rolling extremely thin metal foils, typically aluminum foils down to thicknesses in the range of 10 μm. The term aluminum as used herein is to be understood to also include aluminum alloys. In such extremely thin foils it is difficult to achieve a uniformity of thickness and planarity of the rolled aluminum over the entire width of the aluminum sheet or web. To achieve these characteristics, there is required a degree of precision in maintaining the size of the roll gap or nip which extends down to fractions of a micrometer. This can, however, be achieved in practice only with great difficulty, since the rolls both deflect and flatten due to the roll forces during operation of the rolling mill. The non-uniformities can be reduced at a given press or roll force by employing crowned rolls, roll-bending procedures and differential cooling. However, they can not be fully eliminated.

In order to nevertheless achieve a good uniformity over the entire width of the sheet or web in practice, it is known to select the rolling or line force to be so great that it lies in the region of the rolling force/material-working or line force/deformation characteristic curve of the sheet of metal where the material-working or deformation becomes independent of the press or roll force and where the material-working, i.e. the final thickness of the rolled aluminum, remains at least approximately constant under small variations of the rolling or line force. Certain variations of the rolling or line force over the width of the sheet therefore do not lead to a non-uniformity of the thickness over the width of the sheet, but produce a fairly uniform thickness of the rolled aluminum foil.

It must, however, be taken into consideration that in this so-called saturation region of the rolling or line force, the limiting value of the final thickness is essentially dependent upon the sheet speed and, to a lesser extent, upon the mean tensile stress. For a prescribed final value of the sheet or web thickness, the sheet speed is therefore predetermined and can not be randomly varied. It is, therefore, not possible to increase the sheet speed of the sheet or web in this known rolling method, respectively apparatus, or to regulate it to an optimum value.

A variation of the mean tensile force also yields no improvement, since the tensile force is fixed at a favorable value by other parameters. Too great a tensile force leads to the danger of tearing or rupture of the sheet and too low a mean tensile force leads to the occurrence of waviness in the rolled foil.

SUMMARY OF THE INVENTION

Therefore, with the foregoing in mind, it is a primary object of the present invention to provide a new and improved method and apparatus for rolling metal foils, especially aluminum foils, which do not exhibit the aforementioned drawbacks and shortcomings of the prior art.

Another and more specific object of the present invention aims at providing a new and improved method and apparatus for rolling metal foils in which the uniformity of the rolled metal foil over the width of the sheet or web is improved and in which the speed of the sheet or web can be greater than in hitherto known methods.

Yet a further significant object of the present invention aims at providing a new and improved apparatus for rolling metal foils which is relatively simple in concept, extremely economical to realize, highly reliable in operation, not readily subject to breakdown or malfunction and requires a minimum of maintenance and servicing.

Now in order to implement these and still further objects of the invention, which will become more readily apparent as the description proceeds, the method of the present invention is manifested by the features that it comprises the steps of selecting the sheet speed of the sheet of metal and selecting the rolling or line force pressing the two work rolls together such that the value of the rolling or line force lies below a region in which the thickness reduction of the metal sheet is independent of the value of the rolling or line force at the selected sheet speed, and regulating the rolling or line force variably over the width of the work rolls such that the final value of sheet thickness or thickness reduction has a predetermined profile of variation over the width of the sheet of metal.

The apparatus of the present invention is manifested by the features that it comprises two work rolls for rolling metal foils, especially aluminum foils, and, preferably, back-up rolls bearing against said two work rolls. At least one of said two work rolls and said back-up rolls is constructed as a controlled deflection roll provided with regulatable pressure elements or roll support elements distributed over its width.

The invention thus consciously departs from hitherto known methods which operate in the aforementioned saturation region of the rolling force/material-working or line force/deformation characteristic curve in which a certain increase or decrease of the mean rolling or line force results in practically no alteration of the thickness reduction. The inevitable variations in the rolling or line force to be expected over the width of the work rolls are accommodated by means of the additionally provided possibilities of varying and regulating the rolling or line force over the width of the work rolls.

It is particularly advantageous to construct the work rolls or, in a preferred embodiment, the back-up rolls pressing the work rolls together, as controlled deflection rolls which permit a regulated variation of the rolling or contact force over the roll width. Suitable constructions of controlled deflection rolls are described in, for instance, the U.S. Pat. No. 3,802,044, granted Apr. 9, 1974, or the U.S. Pat. No. 3,885,283, granted May 27, 1975. The pressure elements or roll support elements of these controlled deflection rolls can be particularly advantageously regulated by sensors distributed over the width of the rolled sheet or web and which determine characteristic data, for instance the foil thickness or the tensile force or stress, at the corresponding measurement points and regulate the pressure or roll support force of the individual pressure elements or roll support elements by means of an appropriate regulation device.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
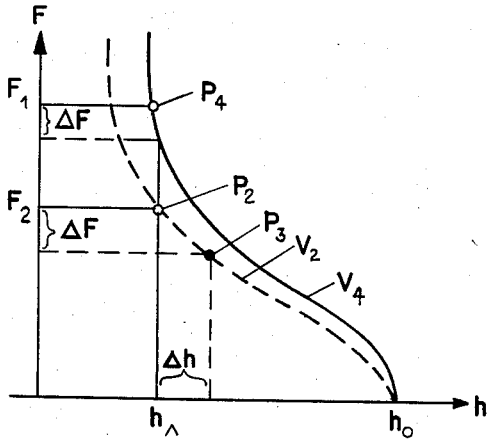
FIG. 1 schematically illustrates a force/material-working or deformation diagram comparing the invention to hitherto known methods.

Describing now the drawings, it is to be understood that to simplify the showing thereof only enough of the structure of the rolling apparatus or rolling mill has been illustrated therein as is needed to enable one skilled in the art to readily understand the underlying principles and concepts of this invention. Turning now specifically to FIG. 1 of the drawings, the rolling force/-material-working or line force/deformation diagram illustrated therein will be seen to represent the dependence of the material-working or deformation or, more precisely expressed, of the final thickness h, of an aluminum foil having the initial thickness $h_o$, when rolled with a rolling or line force F for different sheet speeds $v_1$ and $v_2$, the tensile strength being assumed constant for the sake of simplicity. It will be seen that as the rolling or line force F increases, the thickness after rolling at first decreases from the initial value $h_o$. After a further increase of the rolling or line force to the value $F_1$, a region is attained where the characteristic curve approaches a certain end value, for instance the curve $v_1$ approaches the final thickness $h_1$. A still further increase in the rolling or line force F beyond the force $F_1$ would not lead to any further thickness reduction.

In hitherto known methods for rolling aluminum foils, the operating point $P_1$ was selected at such a high rolling or line force that it fell in this saturation region. This high rolling or line force was necessary in order that the inevitable crowning of the work rolls could be compensated by the deflection of the back-up rolls, which was only possible with a variable rolling or contact force. The final thickness therefore remained nearly constant at a value $h_1$ during variations of the rolling or line force $F_1$ by an amount $\Delta F$ as long as operation took place in the saturation region. The sheet speed could not be randomly increased, for instance could not be increased from the value $v_1$ to a higher optimum value $v_2$, since it was determined by the rolling or line force $F_1$ and the thickness $h_1$.

In order to nevertheless be able to achieve a higher sheet speed $v_2$, according to the invention a significantly lower rolling or line force $F_2$ is intentionally selected for operation, i.e. a rolling or contact force at the operating point $P_2$ where a variation in the rolling or line force by an amount $\Delta F$ does lead to a significant change in sheet thickness. This lower rolling or line force $F_2$ is consciously chosen in departure from the prevalent trend of technological development and in departure from the opinion prevalent in this field of technology. In order to avoid thickness variations over the sheet width as well as deficient planarity which would necessarily arise if the local operating point over the sheet width were to migrate from $P_2$ to, for instance, $P_3$, according to the invention such variations are compensated by making the rolling or line force regulatable over the width of the work rolls. The regulation is effected such that the thickness reduction over the width of the sheet or web corresponds to a desired and prescribed profile, for instance remains approximately constant over the entire sheet width. At the operating point $P_2$ the final thickness is therefore not only determined by the sheet speed but also by the mean rolling or line force.

Figure 2:
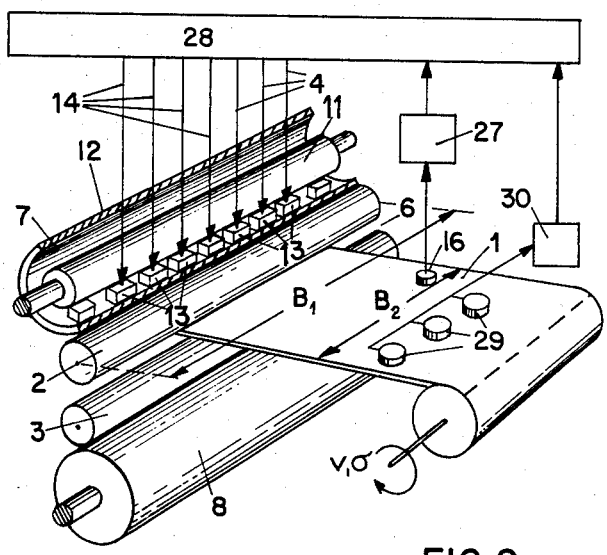
FIG. 2 schematically illustrates one embodiment of a rolling apparatus or mill constructed according to the invention.

FIG. 2 shows, by way of example and not limitation, the apparatus of the invention employed to realize the method as hereinbefore described, which will be seen to comprise a regulation device. The rolled metal sheet or web, here the aluminum sheet 1, is rolled between two work rolls 2 and 3. These two work rolls 2 and 3 are pressed against one another by the back-up rolls 7 and 8 and exert a rolling or line force upon the aluminum sheet 1 in the roll gap or nip 6. One of the back-up rolls 7 is constructed as a controlled deflection roll and comprises a fixed beam or roll support 11 and a roll shell 12 rotatable about the fixed or stationary beam 11 and which is supported upon the fixed beam 11 by means of hydrostatic pressure elements or roll support elements 13 which are supplied through conduits or lines 14 with a suitable pressure medium whose pressure is regulatable. The roll shell 12 is pressed against the work roll 2 in the pressing plane by the pressure of this pressure medium, so that the two work rolls 2 and 3 are pressed against one another with a certain contact or line force.

The controlled deflection roll 7 and the hydrostatic pressure or support elements 13 can, for instance, be constructed according to the previously mentioned U.S. Pat. No. 3,802,044. Other executions can also be employed, for instance ones in which one or more pressure chambers or hydrodynamic pressure elements or electrically, pneumatically or mechanically regulated pressure elements are provided.

The other back-up roll 8 can be constructed as a conventional solid metal roll or can also be constructed as a controlled deflection roll analogous to the back-up roll 7. Alternatively, the work rolls 2 and 3 themselves can be constructed as controlled deflection rolls instead of the back-up rolls 7 and 8.

For regulating the mean rolling or line force, a thickness measuring device 16 is provided on the rolled sheet or web 1 which controls a thickness regulator 27 which, in turn, transmits a regulating signal to a pressure regulation device 28. The pressure in the pressure conduits 14 for supplying the pressure medium to the hydrostatic pressure or support elements 13 is controlled by this pressure regulation device 28, so that the mean rolling or line force assumes a prescribed reference or set value. Additionally, the thickness regulator 27 can also control the sheet speed v.

Additionally, several sensors 29 are provided over the width $B_2$ of the rolled sheet 1, for instance thickness sensors or tensile force or stress sensors of known type. These sensors 29 control a regulator 30 which, in turn, influences the pressure regulating device 28 which individually regulates the pressures in the pressure conduits 14 for supplying the pressure medium to the pressure or support elements 13 such that the sensors 29 detect a prescribed desired profile, for instance a constant value over the entire width $B_2$ of the sheet.

The pressure elements 13 distributed over the width $B_1$ of the work rolls 2 and 3 can be controlled individually or in groups by the pressure regulating device 28, i.e. they can be grouped together with neighboring pressure elements, which in certain cases simplifies the regulation. The control and regulation devices requisite for the regulation are known in the art. Furthermore, suitable devices not particularly shown are provided for generating a predetermined sheet speed v and tensile stress $\sigma$ for the foil sheet 1.

It is to be understood that instead of several sensors 29 distributed over the entire width $B_2$ of the sheet or web 1 and fixedly mounted at predetermined measurement points, a single sensor can also be provided which oscillates over the width of the sheet and transmits appropriate signals to the regulation device 30 in dependence of its momentary position.

Instead of a completely automatic regulation of the pressing force of the individual pressure elements, a semi-automatic regulation can also be provided in which an operator regulates the pressing forces such that the measurement values of the sensors assume prescribed values. A manual regulation of the pressing forces in relation to a visual observation of the rolled foil can also be provided.

Work rolls 1100 mm wide and 165 mm in diameter and back-up rolls 380 mm in diameter were installed in an aluminum foil rolling apparatus or mill as an experimental installation for rolling an alloyed aluminum foil from an initial thickness of 40 $\mu$m to a final thickness of 20 $\mu$m and the apparatus was operated according to the invention. In conventional operation, the rolling apparatus is operated at a pressure force of 550 kN at each side, that is with a total press or roll force of 1100 kN or a mean rolling or line force of 1000 N/mm, and has a sheet speed of 320 m/min. After replacing the back-up rolls by hydrostatic controlled deflection rolls of the commercially available type obtainable from the well known German firm Sulzer-Escher Wyss GmbH, located at Ravensburg, West Germany, and specifically their Escher Wyss Type K for the upper roll and their Escher Wyss Type F for the lower roll together with NIPCO regulators, a qualitatively equivalent aluminum foil of 20 $\mu$m thickness was experimentally produced at a rolling or line force reduced to 550 N/mm but at a sheet speed of 450 m/min, i.e. at about 40% increased machine performance.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method for rolling metal foils, especially aluminum foils, comprising the steps of:

conducting a sheet of material of a predetermined width between two work rolls pressed together with a predetermined line force at a predetermined sheet speed for reducing the thickness of said sheet of material from an initial value to a final value;

selecting said predetermined sheet speed of said sheet of material and said predetermined line force of said work rolls such that said predetermined line force lies below a region in which a thickness reduction of the sheet of material at a given sheet speed is independent of small variations in said line force;

said line force varying over the width of said work rolls; and adjusting said line force such that said thickness reduction of the sheet of material has a predetermined profile over the width of said sheet of material.

2. The method as defined in claim 1, wherein:

said line force adjustment step entails adjusting said line force over said width of said two work rolls such that said thickness reduction is at least approximately constant over said width of said sheet of material.

3. The method as defined in claim 1, further including the steps of:

accomplishing said adjustment of said line force over said predetermined width of said two work rolls by means . of a back-up roll constructed as a controlled deflection roll and acting upon a related one of said work rolls; and said back-up roll constructed as a controlled deflection roll comprising controllable pressure elements distributed over the width of such back-up roll and pressing against said related work roll.

4. The method as defined in claim 3 , further including the step of:

controlling said pressure elements in dependence of sensors distributed over said predetermined width of said sheet of material.

5. In a method for rolling metal foil in which a sheet of metal of a predetermined width is passed between two work rolls pressed together with a predetermined line force and at a predetermined sheet speed for effecting a thickness reduction of the sheet of metal to a final value of thickness thereof, the improvement which comprises:

selecting said sheet speed of said sheet of metal and selecting said line force pressing said two work rolls together such that the value of said line force lies below a region in which said thickness reduction is independent of small variations in the value of said line force at said selected sheet speed; and regulating said line force over said width of said sheet of metal such that said final value of thickness has a predetermined profile of variation over said width of said sheet of metal.

6. The improvement as defined in claim 5, wherein:

said line force is variably regulated over said width of said sheet of metal such that said final value of thickness is at least approximately constant over said width of said sheet of metal.

7. The improvement as defined in claim 5, wherein:

said line force is variably regulated over said width of said sheet of metal by means of a controlled deflection roll defining a back-up roll acting upon a related one of said two work rolls.

8. The improvement as defined in claim 7, wherein:

said controlled deflection roll is regulated in dependence of sensors distributed over said width of said sheet of metal.

* * * * *